United States Patent [19]

Wellekens

[11] 4,094,177

[45] June 13, 1978

[54] TAMPER-RESISTANT LOCK AND KEY ASSEMBLY

[76] Inventor: John F. Wellekens, 41 Crescent Ave., New York, N.Y. 10301

[21] Appl. No.: 825,022

[22] Filed: Aug. 16, 1977

[51] Int. Cl.[2] ..... E05B 17/14

[52] U.S. Cl. ..... 70/423; 70/407

[58] Field of Search ..... 70/423, 455, 402, 403, 70/404, 407, 409

[56] References Cited

U.S. PATENT DOCUMENTS

| | | | |
|---|---|---|---|
| 3,334,501 | 8/1967 | Greenwald | 70/423 |
| 3,444,712 | 5/1969 | Greenwald | 70/423 |
| 3,465,556 | 9/1969 | McIlvenny | 70/423 |

*Primary Examiner*—Robert L. Wolfe
*Attorney, Agent, or Firm*—Allison C. Collard

[57] ABSTRACT

An improved, tamper-resistant lock and key assembly is provided of the type which includes a key having a post and a generally cup-shaped bit having a bitting formed on the outer end thereof, a generally hollow cylinder, and a circular, pin-type tumbler mechanism housed within the cylinder and defining therewith an annular keyway. The key may be inserted a fixed distance into the keyway to permit rotation thereof between a release and locking position. The improved assembly provides a key having a key bit which has a notched portion formed therein radially inwardly of the bitting thereof and means for obstructing direct access of the key bit to the keyway. The obstruction means includes an obstruction member spaced above and generally overlying the keyway, which necessitates lateral shifting of the key bit therebelow to effect alignment thereof with the keyway. The obstruction member also includes an abutment shoulder spaced above and overlying a portion of the keyway, which is configured and dimensioned to mate with the notched portion of the key bit to permit alignment of the bitting of said bit with the keyway.

11 Claims, 13 Drawing Figures

FIG.2
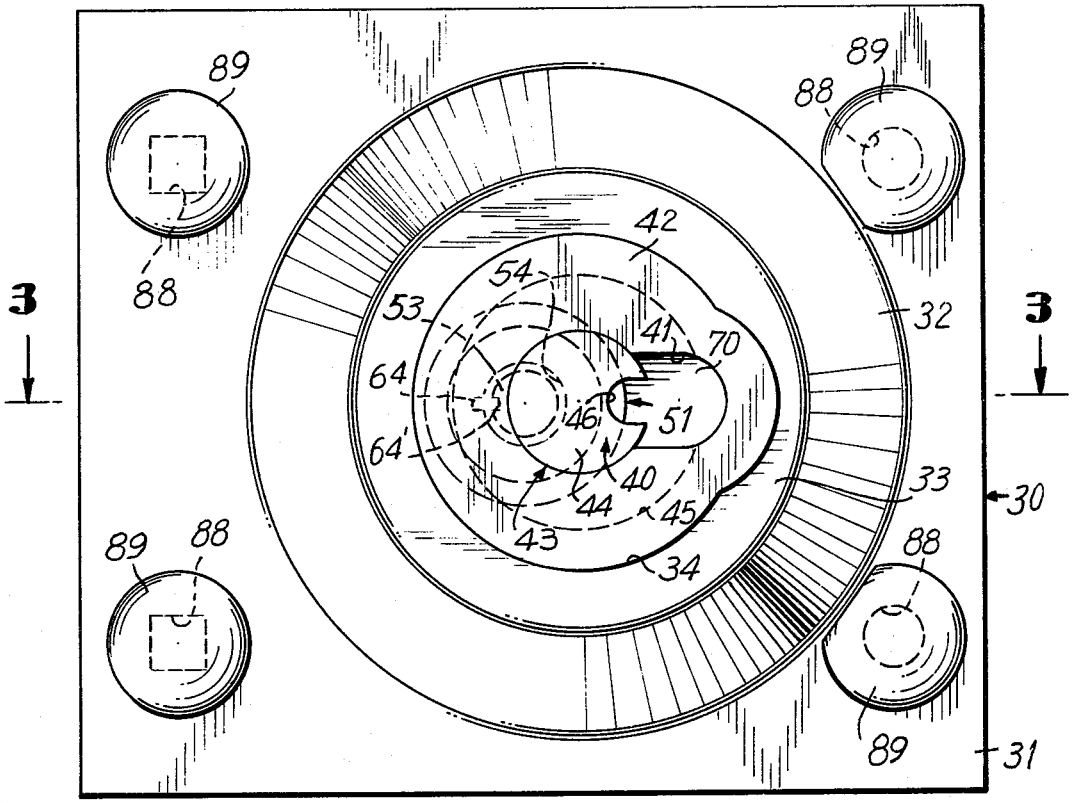
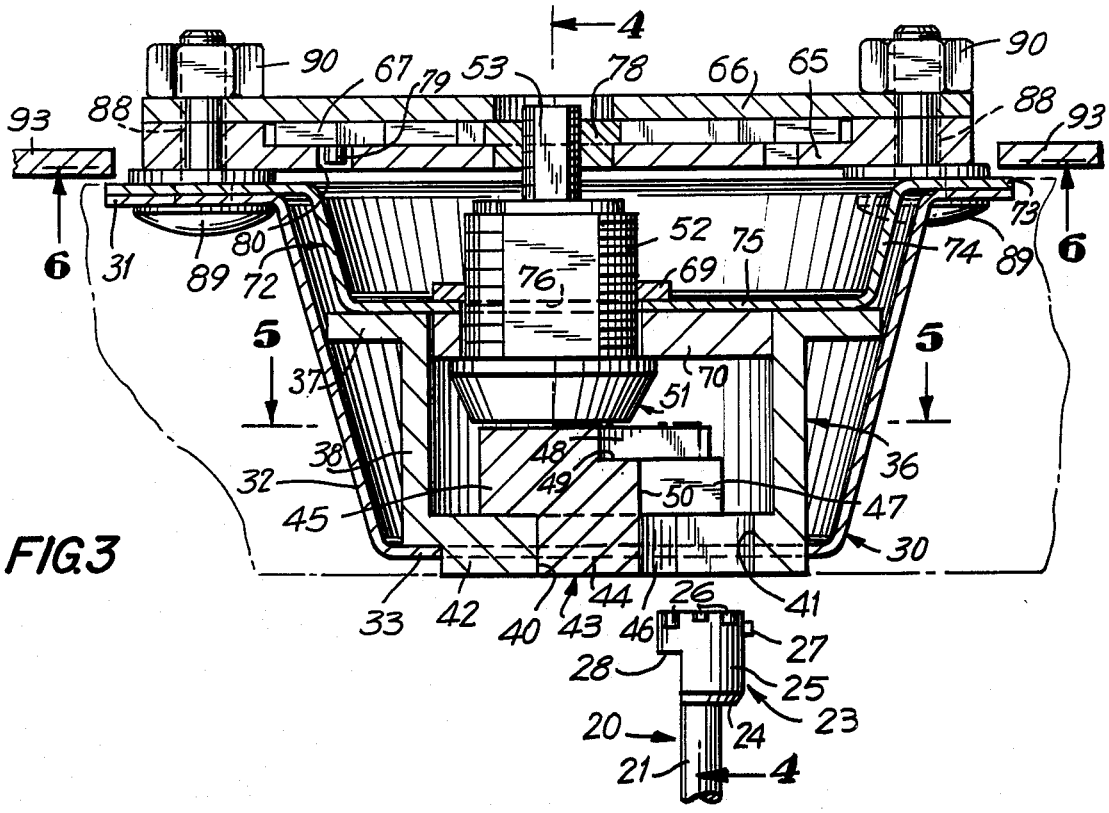
FIG.3

TAMPER-RESISTANT LOCK AND KEY ASSEMBLY

This invention relates to a tamper-resistant lock and key assembly. More particularly, it relates to an improved tamper-resistant lock and key assembly which has a circular, pin-type tumbler mechanism.

Various types of so-called "pick-proof" lock and key assemblies are well known and widely used. Particularly in the vending machine industry, the circular, pin-type tumbler lock and key assembly has gained wide acceptance and favor due to its supposedly "pick-proof" feature.

Locks of this type generally include a hollow cylinder and a pin-type tumbler mechanism housed within the cylinder which has a central, rotatable plug carrying an upper ring which supports a first set of slidably movable tumbler pins arranged in a circle. A second lower ring carries a second set of tumbler pins which are spring-loaded and are also arranged in a circle. The second ring is received on the plug in abutting relationship to the upper ring, but is fixed to the cylinder. The pin channels of the two rings are aligned so that the pins of the lower ring will normally protrude into the pin channels of the upper ring (due to their springloading), thereby preventing turning of the central plug; this being the normal locking position. To move the pins to an open position, it is necessary to align the abutting ends of the coacting pins at the so-called "cleavage" or "shear" line separating the two rings. This will permit rotation of the first ring and the cylinder plug, thus effecting opening of the lock.

This is normally accomplished by means of a specially-configured key which includes a shaft to which a generally cup-shaped bit is attached. The key bit is receivable within an annular keyway defined between the cylinder and tumbler plug which keyway is at least partially aligned with the pins of the first ring. The key bit is inserted into the keyway and engages and depresses the pins of the upper ring which, in turn, effects alignment of the pins at the shearline, thus permitting rotation of the central plug.

In order to prevent tampering with the lock, the pins of the upper ring are usually provided with different lengths, so that they will have to be depressed by different amounts to effect alignment of the pins relative to the shearline. As a result, the keybit is usually provided with a series of cuts, commonly referred to as a bitting on the outer end thereof. The depths of the cuts of the bitting correspond to the different lengths of the pins, so that upon insertion of the key bit into the keyway, the pins will be depressed an appropriate amount so as to effect clearing of the shearline, thus permitting unlocking of the lock.

While key and lock assemblies of this type have been generally found to be satisfactory, particularly in terms of tamper-resistance, they, too have been found not to be "tamper-proof". Recently, these locks have been picked by means of a pick which consists of a plurality of relatively rigid wires arranged and supported in a circle, which are aligned with the pins of the tumbler mechanism. The wires are sequentially inserted into the keyway to depress one of the paired pins a sufficient distance to clear the shearline. A tensioning tool is used to apply a certain amount of pressure on the cylinder core, so that once the first set of pins is arranged at the shearline, the cylinder core will rotate (although slightly) to set the first pair of pins at the shearline. This is sequentially followed with each of the other wires and pin pairs until all the pins are arranged at the shear line. Then, the centrol plug may be rotated and the lock opened.

So far as is knwon, no presently available lock and key assembly has been able to forestall use of this type pick and, consequently, there is a great need for a lock and key assembly which would prevent this type of tampering which has now become relatively widespread.

Accordingly, it is an object of the present invention to provide an improved, novel lock and key assembly having a circular, pin-type tumbler mechanism, which greatly minimizes the possibility of tampering.

It is also an object of this invention to provide such a lock and key assembly which is of simple and economic construction, easy to use and install and which is reliable in operation.

Certain of the foregoing and related objects are readily attained in an improved, tamper-resistant lock and key assembly of the type including a generally hollow cylinder, a circular, pin-type tumbler mechanism housed within said cylinder and defining therewith an annular keyway into which a key may be inserted a fixed distance to permit rotation thereof between a release and locking position. The key is of the type which includes a post and a generally cup-shaped bit having a generally circular base secured to one end of the post and which extends generally radially outwardly therefrom and a generally cylindrical sidewall secured to the base which extends generally axially outwardly from the end of the post; the outer end of which has a bitting formed thereon. The improved assembly is particularly characterized by the provision of a key including a key bit having a notched portion formed therein inwardly of the bitting thereof and means for obstructing direct access of the key bit to the keyway. The obstruction means includes an obstruction member spaced above and generally overlying the keyway which necessitates laterally shifting of the key bit therebelow to effect alignment thereof with the keyway. The member includes an abutment shoulder spaced above and overlying a portion of the keyway which is configured and dimensioned to mate with the notched portion of the key to permit alignment of the bitting of the key bit with the keyway. The member also accommodates the post of the key in axial alignment with the keyway to permit insertion of the key bit into the keyway.

Preferably, the obstruction member includes an upper element which obstructs direct access of the key bit to the keyway and which has a grooved lateral edge portion for accepting and accommodating only the post of the key in axial alignment with the keyway. The member also includes a lower element, disposed in abutting relationship beneath the upper element, having a grooved lateral edge portion disposed beneath, and opening in the same direction of, the grooved lateral edge portion of the upper element, for accepting and accommodating the key bit in axial alignment with the keyway. The abutment shoulder is secured to the grooved lateral surface of the lower element in a laterally offset position relative to the grooved, lateral edge portion of the upper element and is spaced above and overlies a portion of the keyway. The key is positionable adjacent to the obstruction member and is laterally shiftable toward the member so that the post of the key will be received in the grooved lateral edge portion of the upper element and so that the bit of the key may be slid beneath the upper element and received within the grooved lateral edge portion of the lower element, with the notched portion thereof in abutting and mating relationship with the shoulder.

Most desirably, the post has a generally cylindrical configuration of reduced cross-section relative to that of the cylindrical sidewall of the bit and the grooved lateral edge portions of the upper and lower elements of the obstruction member, each has a generally U-shaped configuration, the cross-sectional dimensions of which substantially correspond to that of the post and bit, respectively. Most advantageously, the upper and lower elements of the obstruction member each has a generally disc-shaped configuration, with the lower element having a greater diameter than that of the upper element.

In a preferred embodiment of the invention, the obstruction member is rotatably movable between a first position, which prevents alignment of the key bit with the keyway, and a second position, which permits alignment of the key bit with the keyway. The assembly also desirably includes a hollow housing having a first opening in which the obstruction member is rotatably received and a second opening which merges with the first opening, into which the key may be inserted to permit laterally shifting thereof toward the obstruction member; the second opening is positioned so as to permit insertion and removal of the key only when the obstruction member is in its non-aligned position.

In a particularly preferred embodiment, the first and second positions of the obstruction member are rotatably offset by 180 degrees and the upper element of the obstruction member is rotatably received in the first opening of the housing, with the lower element disposed in the housing and underlying the first opening. Most desirably, the hollow housing has a generally cup-shaped configuration and includes a generally circular base in which the openings are formed and a generally cylindrical sidewall secured to the base. It is especially desirable that the abutment should be spaced above the keyway at a distance that is less than that of the fixed permissable distance of the key bit insertion in the keyway.

Other objects and features of the present invention will become apparent from the following detailed description when taken in connection with the accompanying drawings which disclose a single embodiment of the invention. It is to be understood that the drawings are designed for the purpose of illustration only, and are not intended as a definition of the limits and scope of the invention disclosed.

In the drawings wherein similar reference numerals denote similar elements throughout the several views:

FIG. 2 is a top elevational view of the lock shown in FIG. 1, in an assembled condition and showing the position of a protective bushing obstructing access to the keyway and tumbler mechanism represented in phantom line;

FIG. 3 is a cross-sectional view, in part elevation, taken along line 3—3 of FIG. 2, also showing the position of the key prior to insertion in the lock;

Figure 1:
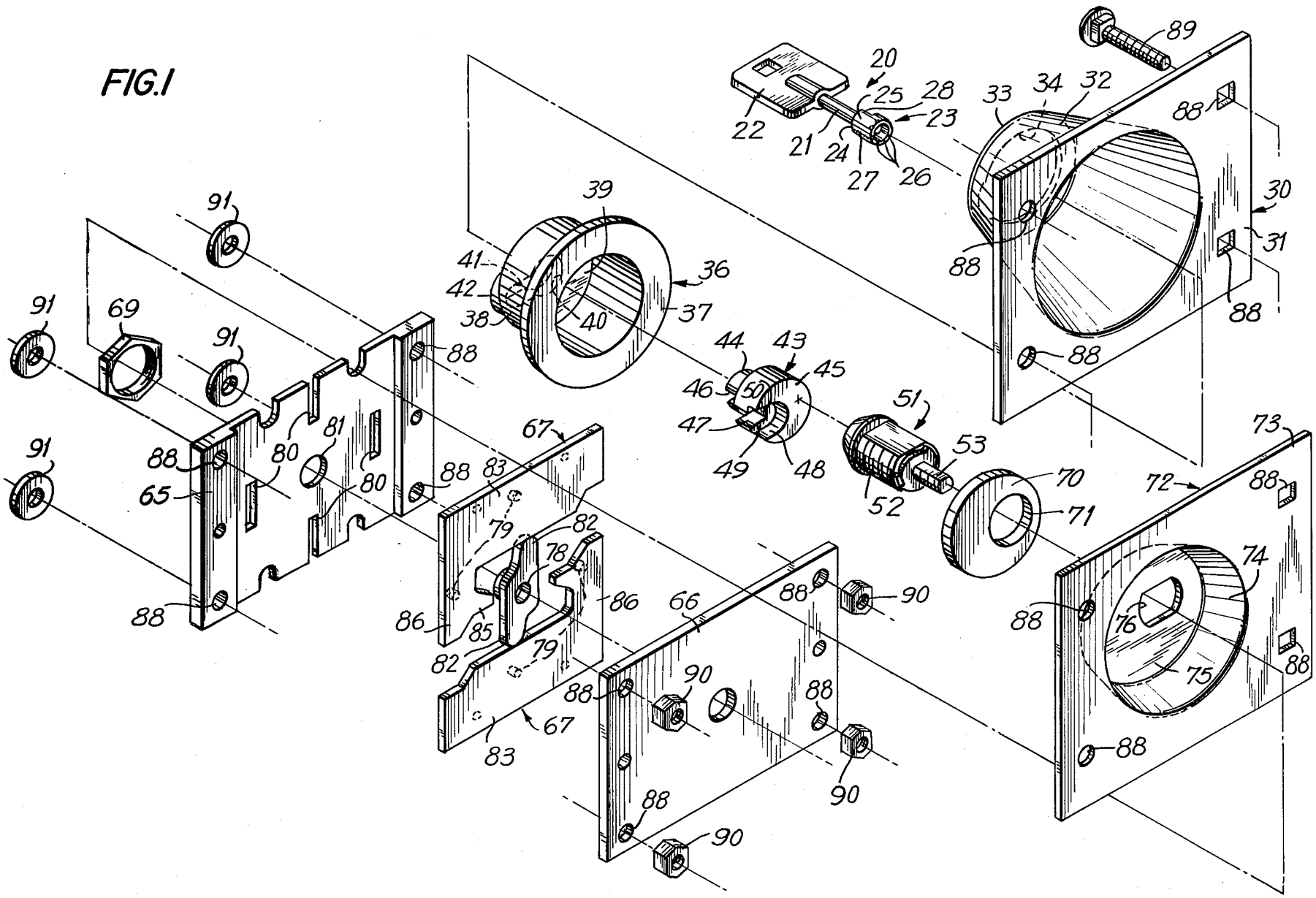
FIG. 1 is an exploded perspective view of a novel lock and key assembly embodying the present invention.

Turning now in detail to the appended drawings and, in particular FIG. 1 thereof, therein illustrated is a novel tamper-resistant lock and key assembly embodying the present invention and including a key 20. Key 20 includes a cylindrical post 21, one end of which is attached to a bow or handle portion 22 and the other end of which is attached to a generally cup-shaped key bit 23. Key bit 23 consists of a generally circular base 24 secured to the end of post 21 and a generally cylindrical sidewall 25 secured to base 24 and extending axially outwardly from post 21. Sidewall 25 has a series of radially-spaced, semi-cylindrical cuts 26, known as a bitting, formed on its outer end and a pair of alignment pins 27 formed inwardly of bitting 26, one being on the outside and one being on the inside of sidewall 25 (see FIG. 5). Key bit 23 is also provided with a notched lateral edge portion 28 having a generally L-shaped profile which is formed at a corner portion of key bit 23 at the intersection of its base 24 and sidewall 25, opposite alignment pins 27. The functions of these various features of key 20 will be described in greater detail hereinbelow.

The lock of the assembly includes an outer housing 30 having a generally rectangular-shaped, apertured, flat baseplate 31 having a circular inner periphery from which forwardly extends a hollow, truncated, cone-shaped sidewall 32. The outer end of sidewall 32 merges with a top plate 33 having a generally circular opening 34 formed therethrough. The assembly also includes a protective bushing housing 36 having an annular-shaped, flat baseplate 37 from which forwardly extends a cylindrical sidewall 38, the outer end of which has formed thereacross a circular top face 39. Top face 39 has a coaxially-disposed, circular opening 40 formed therethrough which merges with an axially offset, generally U-shaped slot 41, the latter of which is dimensioned to permit insertion of key 20 therein. Opening 40 and slot 41 are surrounded by a raised lip 42 which has a generally circular, outer periphery which seats within opening 34 in top plate 33 of outer housing 30.

A protective bushing 43 is rotatably supported in bushing housing 36. Bushing 43 includes a disc-shaped upper element 44, which is seated for rotatable movement in opening 40, and a coaxially disposed and enlarged disc-shaped lower element 45. Upper element 44 has a generally U-shaped, grooved lateral edge portion 46 which is suitably dimensioned to accommodate, with relatively close tolerances, post 21 of key 20. Similarly, lower element 45 has a generally U-shaped, grooved lateral upper edge portion 47, and a further enlarged, generally U-shaped, lateral lower edge portion 48 (joined to edge portion 47 by an inset shoulder 49), both of which open in the same direction as that of the grooved lateral edge portion 46 of upper element 44 and serve to accommodate bit 23 of key 20. Lower element 45 also includes a generally L-shaped abutment shoulder 50 formed across the base of grooved lateral edge portion 47 which is configured to receive and mate with notched portion 28 of key bit 23. Bushing 43 is rotatably supported by bushing housing 36 so that the grooved lateral edge portions of its upper and lower elements 44, 45 may be moved into, and out of, general alignment with slot 41 of housing 36 (the function of which will be described in greater detail hereinbelow).

Bushing 43 is positioned above a conventional lock cylinder 51. As can be seen more clearly in FIGS. 12 and 13, cylinder 51 includes a hollow, cylindrical, partially externally-threaded housing or casing 52, in which a circular or rotary pin-type tumbler mechanism is housed. The tumbler mechanism consists of a cylindrical, rotatable shaft or plug 53, the upper end of which, in cooperation with casing 52, defines an annular keyhole or keyway 54, into which key bit 23 may be inserted. Shaft 53 carries a coaxially-disposed upper ring 55, adjacent to its upper end, which has a plurality of radially spaced-apart, axially-extending cylindrical channels 56 formed therethrough and disposed in a circular array (only two of which are shown) in each of which a top tumbler pin 57 is slidably mounted. A lower ring 58 is freely supported on shaft 53 (immediately below upper ring 55) and is fixed to casing 52 by means of a screw 59. Lower ring 58 also has a plurality of axially-extending, radially spaced-apart, cylindrical channels 60 formed therein in a circular array, in each of which a bottom tumbler pin 61 is slidably mounted. Bottom tumbler pins 61 are spring-loaded by means of tumbler coil springs 62. Channels 56, 60 are appropriately arranged such that each of the top pins 57 will normally be aligned with one of the bottom pins 61 and so that pins 57, 61 will at least be partially aligned with keyway 54.

Figure 13:
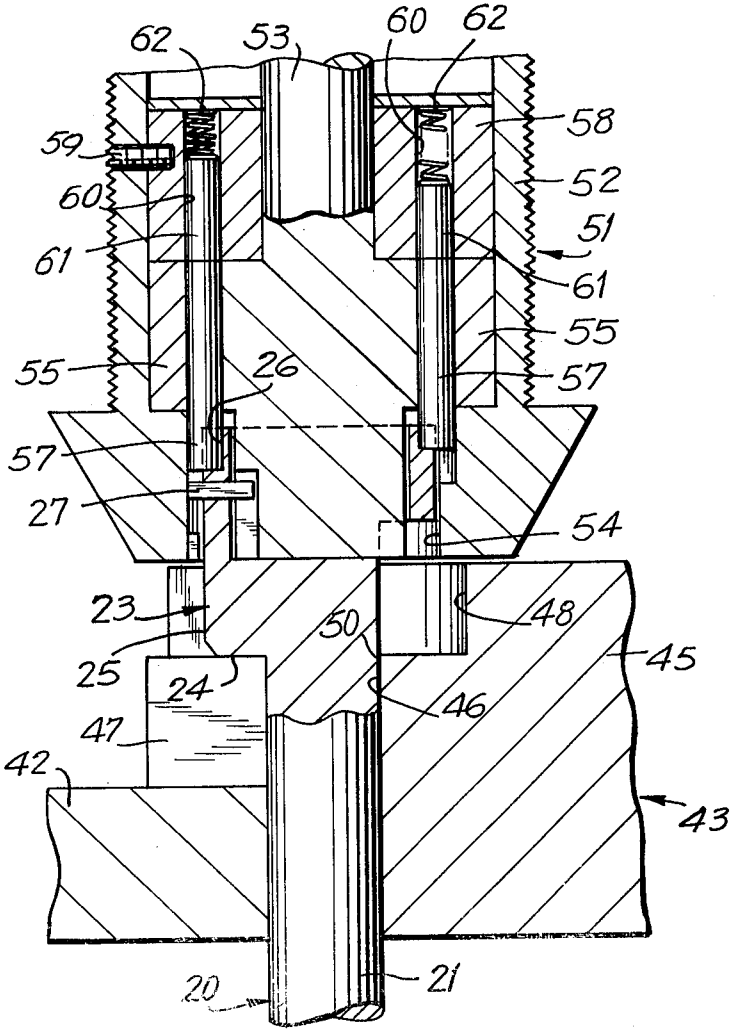
FIG. 13 is a diagrammatic representation similar to that of FIG. 12 but showing full insertion of the key bit into the keyway.
Figure 12:
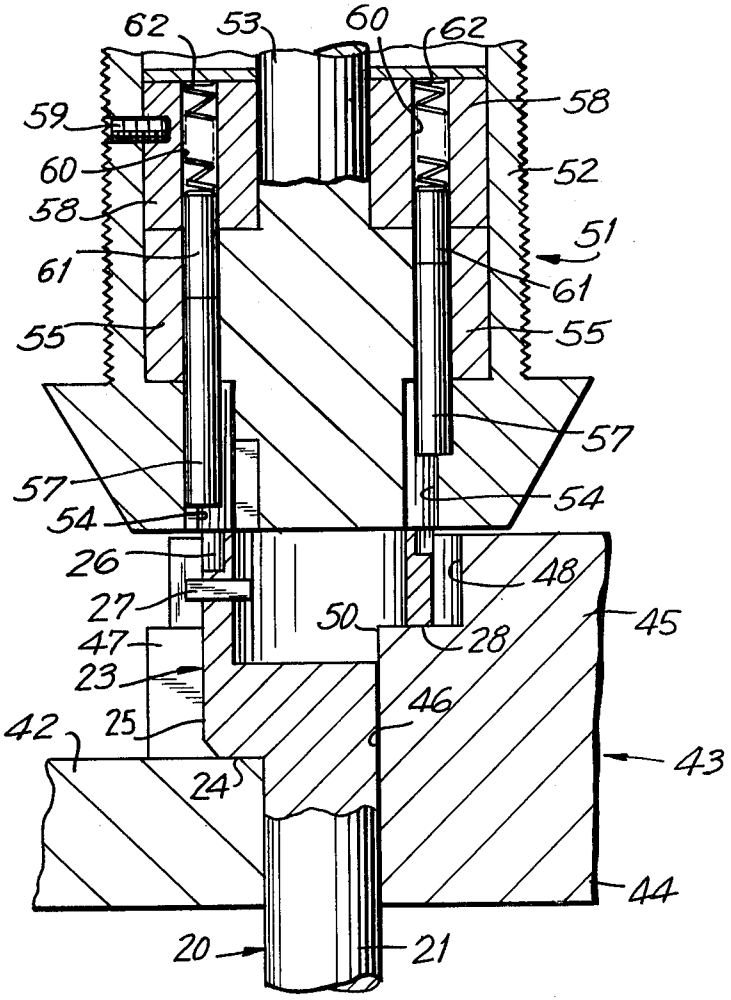
FIG. 12 is a diagrammatic representation of the lock and key assembly, showing the position of the key prior to insertion and also the internal construction of the tumbler mechansim.

As shown in FIG. 12, due to their spring-loading, bottom pins 61 normally protrude into channels 56 of upper ring 55, thus preventing rotation of shaft 53 and, in turn, opening of the lock. However, as shown in FIG. 13, by insertion of key bit 23 into keyway 54, the key bitting 26 will engage top tumbler pins 57 and upon full insertion of key bit 23, will push the coacting pairs of top and bottom tumbler pins 57, 61 downwardly until their abutting ends are aligned at the shear line defined between the bottom face of the upper ring 55 and the top face of lower ring 58. This, in turn, permits rotation of shaft 53 and opening of the lock.

It should be noted that the top tumbler pins will typically have different lengths as a result of which they will have to be depressed different amounts to effect alignment of the pins at the shear line. Accordingly, each of the notches of the key bitting has to be correspondingly dimensioned so as to effect proper positioning of the tumbler pins at the shear line upon complete key bit insertion. As can be appreciated, this minimizes the possibility of tampering with the lock since it is particularly difficult to align each of the pairs of coacting top and bottom pins at the shear line without the correct key. In this regard, it should also be pointed out that, as can be seen in FIG. 2, cylinder casing 52 and the upper end of shaft 53 are each provided with an opposing, axially-extending slot 64, 64', in which the outer and inner alignment pins 27 of key bit 23 are slidably received during initial key insertion into keyway 54. This ensures that notches 27 of key bit 23 are aligned with the corresponding pair of pins for which they are intended. In addition, upon complete key bit insertion and alignment of the tumbler pins at the shear line, the internal alignment pin 27, received in slot 64' of shaft 53, will upon manual rotation of key bow 22, effect rotation of shaft 53; the external alignment pin being slidably received within an internal annular slot (not shown), formed in the interior wall of casing 52, upon full key bit 23 insertion.

Lock cylinder 53 is held in abutting relationship with protective bushing 43 by means of a disc-shaped reinforcement plate 70 which is dimensioned to permit seating thereof against the interior surface of sidewall 38 of bushing housing 36. Plate 70 has an axially offset, circular opening 71 formed therethrough in which the externally-threaded portion of cylinder casing 52 is supported. Cylinder 51 is held in a stationary, fixed position by means of a block support housing 72. Block support housing 72 includes a rectangular, apertured baseplate 73 having a circular inner periphery from which forwardly extends a generally truncated, cone-shaped sidewall 74. The upper end of sidewall 74 merges with a circular top plate 75 extending thereacross. Top plate 75 has a generally rectangular, axially-offset opening 76 formed therethrough, in which the complementary-shaped, threaded casing 52 of cylinder 51 is received. Sidewall 74 is suitably dimensioned to permit seating thereof against the interior surface of sidewall 32 of outer housing 30. A nut 69, threadably received on threaded casing 52, is provided to securely fasten cylinder 51 to housing 72.

Figure 6:
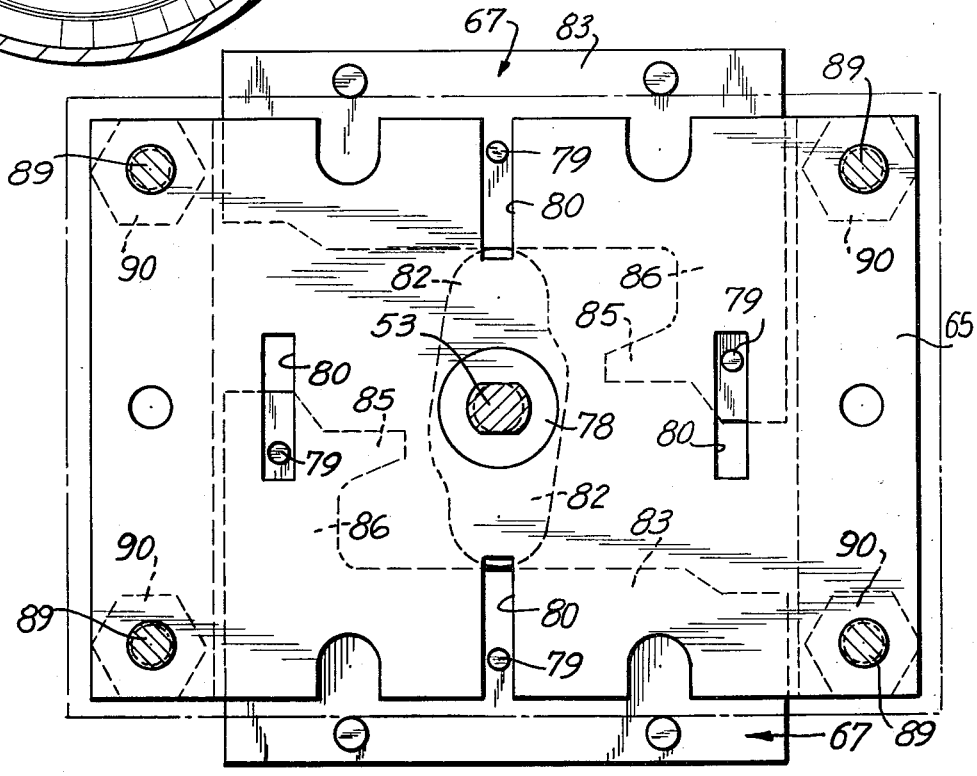
FIG. 6 is a sectional view, in part elevation, taken along line 6—6 of FIG. 3 and showing in phantom line, the latching mechanism in a locking position.
Figure 11:
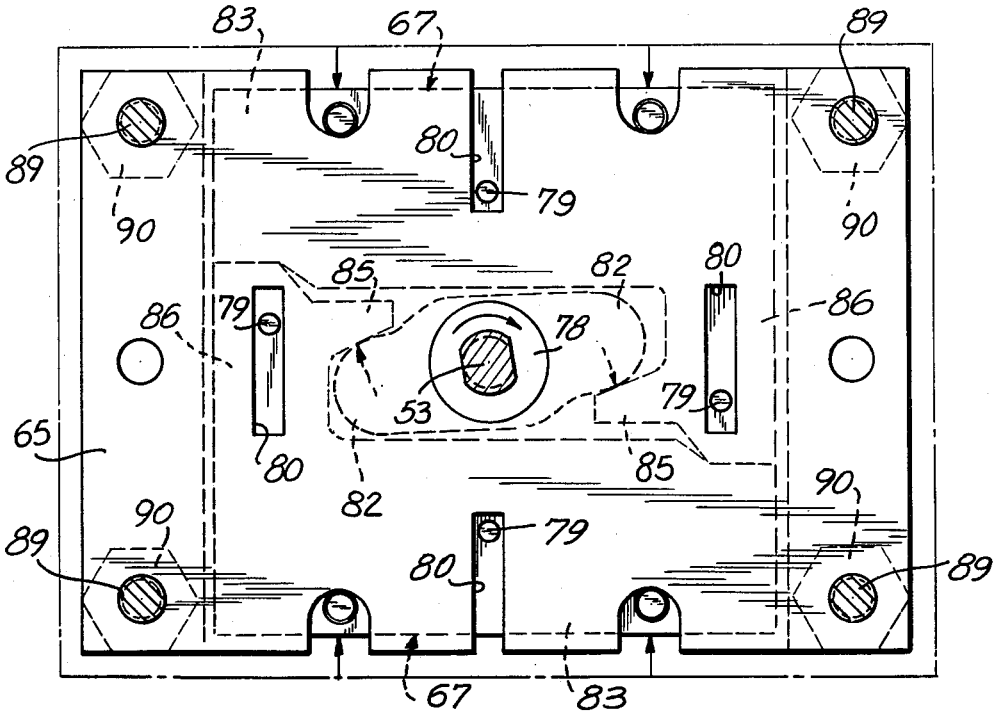
FIG. 11 is a sectional view, in part elevation, taken along line 11—11 of FIG. 10 and showing in phantom line the latch mechanism in an unlocking position.

Supported adjacent to the rear face of baseplate 73 is a latching mechanism which includes a front rectangular latching plate housing 65, a rear rectangular latching plate housing 66 and a pair of generally L-shaped upper and lower latching plates 67 and a lock cam 78 disposed therebetween. As seen more clearly in FIG. 6, each of the latching plates 67 has a pair of alignment pins 79 projecting outwardly from the front face thereof, which are slidably receivable in correspondingly positioned slots 80 formed in front latching plate housing 65, to permit movement thereof between a latching and unlatching position. Lock cam 78 is positioned between latching plates 67 and is rotatably supported in a circular opening 81 formed through front latching plate 65. Lock cam 78 is fixed to rotatable shaft 53 of cylinder 51 for rotation therewith. As shown in the position of FIGS. 1 and 6, upon clockwise rotation of shaft 53, arms 82 of lock cam 78 engage the longer legs 83 of latching plates 67, causing plates 67 to slide outwardly to a latching position. Conversely, as shown in FIG. 11, upon counterclockwise rotation of cylinder shaft 53 and, in turn, lock cam 78, cam arms 82 will engage the abutments 85 projecting inwardly from the shorter legs 86 of latching plates 67, causing the plates 67 to slide inwardly to an unlatching position.

To facilitate assembly of the lock, outer housing 30, block support housing 57, and front and rear latching plates 65, 66 are each provided with four screw holes 88 through which threaded bolts 89 may be received and fastened by means of nuts 90. Four compressable nylon bushings 91 are also employed between the screw holes of the block support housing 72 and the front latching plate housing 65.

Figure 4:
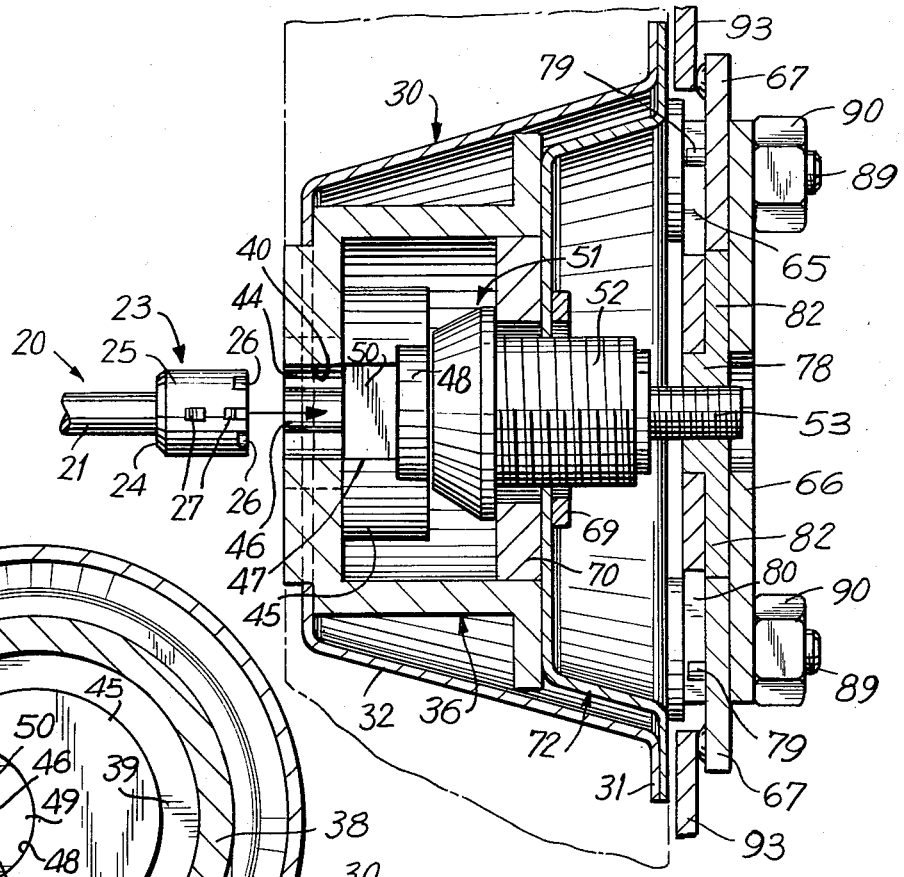
FIG. 4 is a sectional view, in part elevation, taken along line 4—4 of FIG. 3.
Figure 5:
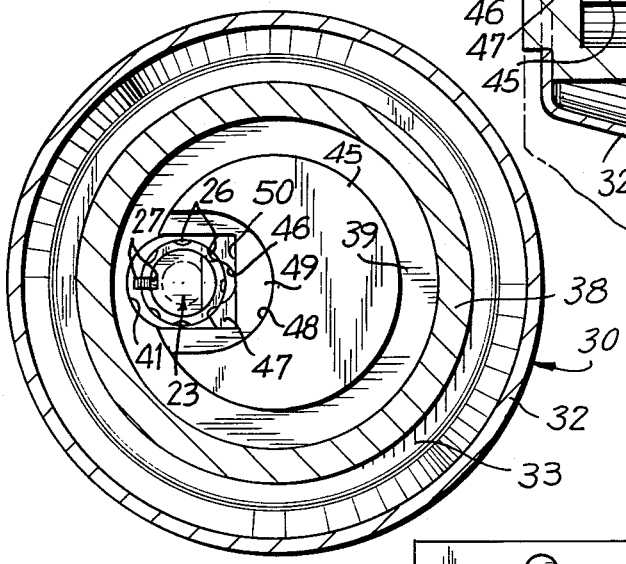
FIG. 5 is a sectional view, in part elevation, taken along line 5—5 of FIG. 3.
Figure 7:
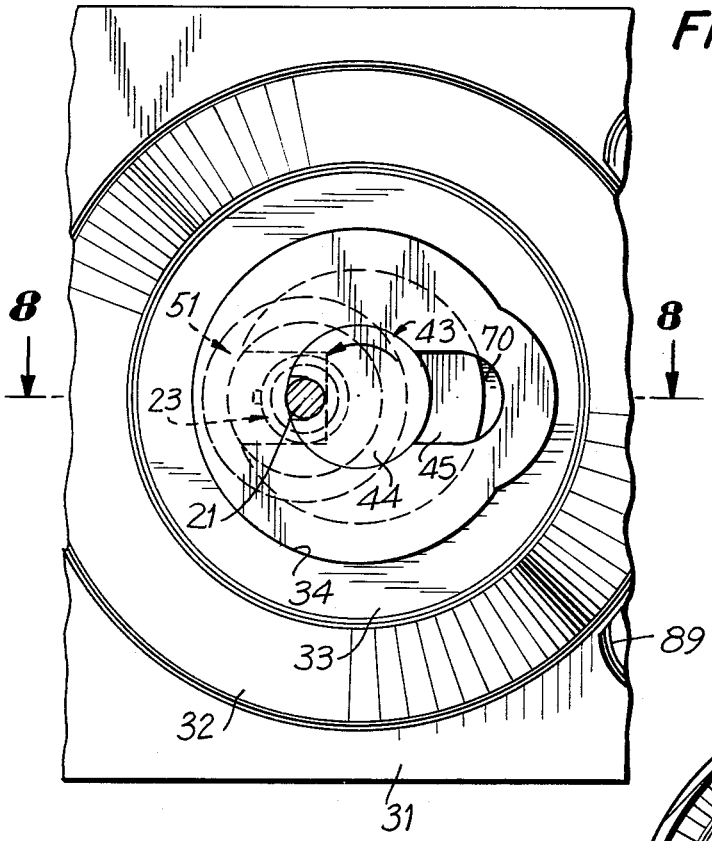
FIG. 7 is a fragmentarily-illustrated top elevational view, in part section, similar to that of FIG. 2 but showing the bushing rotated to permit alignment of the inserted key with the keyway.
Figure 9:
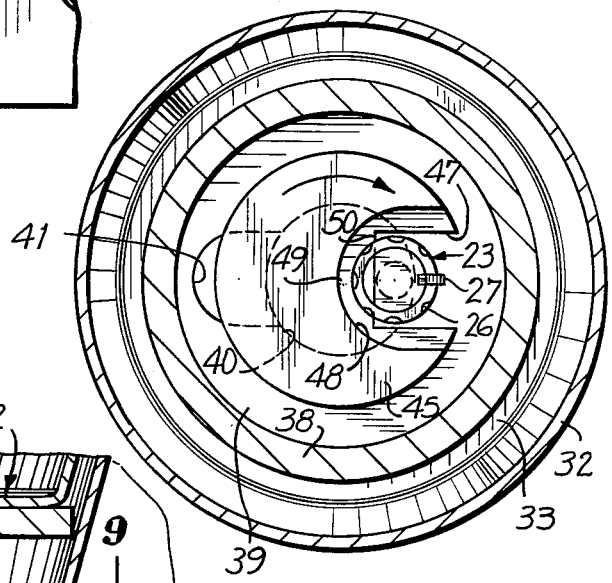
FIG. 9 is a sectional view, in part elevation, taken along 9—9 of FIG. 8.
Figure 8:
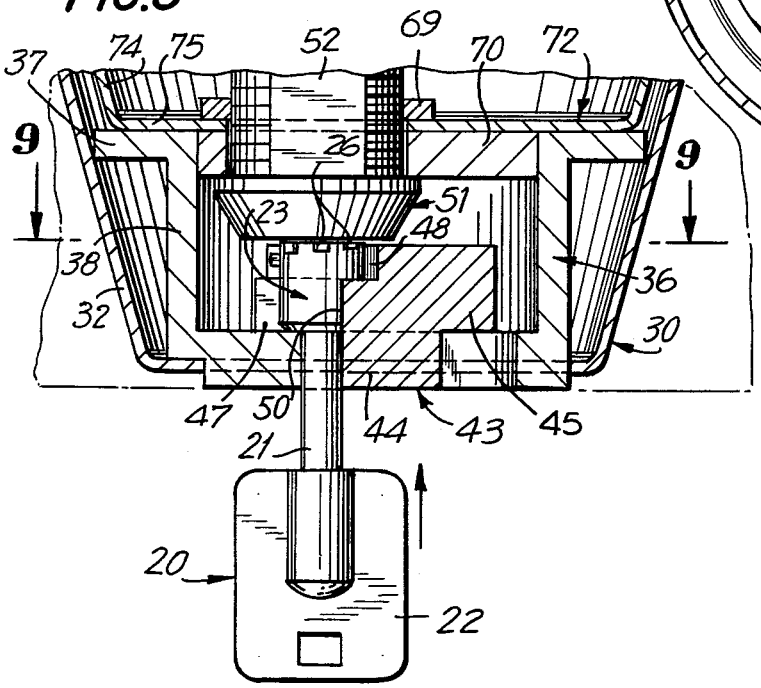
FIG. 8 is a sectional view, in part elevation, taken along line 8—8 of FIG. 7, also showing the bow of the key.
Figure 10:
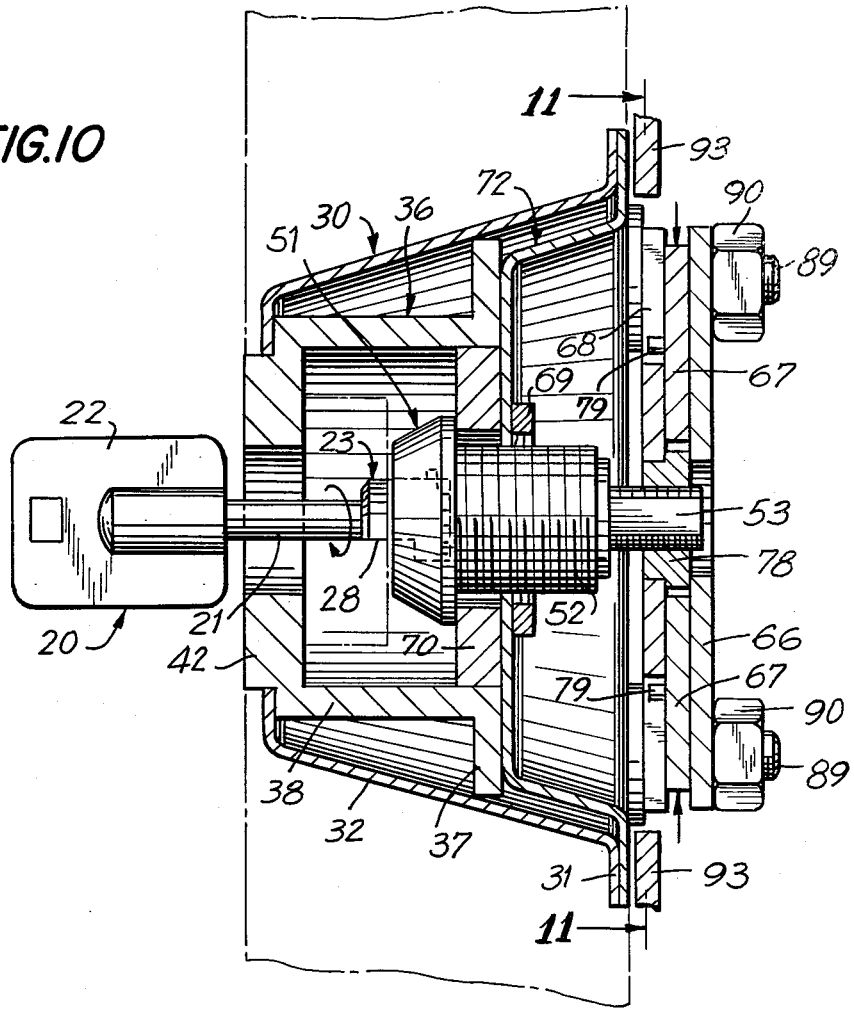
FIG. 10 is a sectional view, in part elevation, comparable to that of FIGS. 4 and 8, showing full insertion of the key bit into the keyway of the cylinder and with the protective bushing removed for purposes of clarity.

Turning now more specifically to the sequence of steps necessary to effect opening of the lock, initially, the lock components will normally be set in the position shown in FIG. 2. As illustrated therein, direct access to lock cylinder 51 and keyway 54 is obstructed by top plate 39 of protecting bushing housing 36 and protective bushing 43, due in part to the offset mounting of cylinder 51 in plate 70 and block support housing 72. As depicted in FIGS. 3, 4 and 5, in order to permit access of key 20 to keyway 24, the key must initially be inserted into slot 41 of bushing housing 36 and oriented such that notched portion 38 of key bit 23 is facing bushing 43. Then, key 20 is shifted or slid laterally toward bushing 23 until its shaft 21 is received within grooved lateral edge portion 46 of bushing upper element 44 and its bit 23 is received within grooved lateral edge portions 47, 48 of bushing lower element 45, and with the notched lateral edge portion 28 thereof received on abutment shoulder 50. As shown in FIGS. 7, 8 and 9, at this point key 20 and bushing 43 are then pivoted 180 degrees to align key bit 23 with cylinder keyway 54. Thereafter, as depicted in FIG. 10, key 20 is inserted a predetermined distance (i.e., approximately the length of sidewall 25) into keyway 54 to align the tumbler pins at the shear line. Consequently, key 20 may be then rotated in a clockwise direction which will, in turn, effect clockwise rotation of cylinder shaft 53. As can be seen in FIG. 11, lock cam 78 will also be rotated and arms 82 thereof will cause latching plates 67 to slide inwardly to an unlocking position, releasing them from engagement with latching member 93. As can be appreciated, to effect relocking and removal of the key, the aforementioned steps are simply reversed.

It should be pointed out that the utilization of rotatable bushing 43 and key 20 with its notched lateral edge portion 28 is extremely effective in preventing tampering or picking of the lock. More specifically, as previously mentioned, direct, unobstructed access to cylinder keyway 54 is prevented by bushing 43 and top plate 39. In addition, although bushing 43 may be rotated without a key to generally align the grooved lateral edge portions thereof with cylinder 51, the outer opening provided by grooved lateral edge portion 46 of upper element 44 is relatively small, since it simply serves to accommodate the narrow post 21 of key 20. As a result, it will not provide clear and facile access to at least some of the tumbler pins and, accordingly, it effectively hampers tampering of the lock with a series of pick wires, as previously described.

Moreover, as can be seen from FIGS. 9, 12 and 13, when the grooved lateral edge portions of bushing 43 are generally aligned with cylinder 51, abutment shoulder 50 overlies a portion of keyway 43 and several tumbler pins. Accordingly, in order to reach these pins, the pick wires will have to be provided with a laterally offset outer end which will require the formation of two severe bends in the wire. This, in turn, will make picking of the lock considerably more difficult. In fact, the lock of the present invention may even be made practically "pick-proof" if certain important parameters are maintained. More specifically, the distance between the lower edge of abutment shoulder 50 and the upper end of keyway 54 should be less than the fixed distance of insertion of key bit 23 into keyway 54. As can be appreciated, although the pick wires may possibly be bent to effect alignment thereof with the tumbler pins underlying abutment shoulder 50, due to the shorter distance between abutment shoulder 50 and keyway 54 relative to that of the fixed insertion distance, the bent outer end portions thereof will not be of sufficient length to permit them to traverse the longer required fixed distance of key bit insertion. Hense, they are prevented from effecting proper alignment of the tumbler pins at the shear line which, of course, will prevent picking of the lock.

while the instant assembly has been described in relation to the illustrated and preferred embodiment, it should be understood that modifications may be made, as will be apparent to those skilled in the art. For example, various types of cylinders having circular or rotary pin-type tumbler mechanisms other than that described and shown herein, may be utilized with the instant assembly. The number of paired tumbler pins employed may also be varied, although, typically, one to seven pin pairs are used. In addition, a wide variety of latching mechanisms could be suitably incorporated into the lock assembly. The configurations and dimensions of the various components may also be modified, so long as their proper functioning remains unimpaired. For instance, the diameter of the lower element of the bushing could be considerably enlarged so that during alignment of its grooved lateral edge portions with the cylinder, it will entirely seal off the U-shaped slot formed in the top plate of the bushing housing, thereby preventing the entry of dirt and other contaminants into the lock.

What is claimed is:

1. An improved, tamper-resistant lock and key assembly of the type including a generally hollow cylinder, a circular, pin-type tumbler mechanism housed within said cylinder and defining therewith an annular keyway, into which a key may be inserted a fixed distance to permit rotation thereof between a release and locking position, and a key including a post and a generally cup-shaped bit having a generally circular base secured to one end of said post and extending generally radially outwardly therefrom and a generally cylindrical sidewall secured to said base and extending generally axially outwardly from said end of said post, said sidewall having a bitting formed on the outer end thereof, the improvement comprising:

said key bit having a notched portion formed therein inwardly of said bitting thereof; and means for obstructing direct access of said key bit to said keyway, said means including an obstruction member spaced above and generally overlying said keyway, which necessitates laterally shifting of said key bit therebelow to effect alignment thereof with said keyway, said member including an abutment shoulder spaced above and overlying a portion of said keyway, which is configured and dimensioned to mate with said notched portion of said key to permit alignment of said bitting of said bit with said keyway.

2. The assembly according to claim 1, wherein said obstruction member includes an upper element which obstructs direct access of said key bit to said keyway and which has a grooved lateral edge portion for accepting and accommodating only said post of said key in axial alignment with said keyway and a lower element having a grooved lateral edge portion disposed beneath, and opening in the same direction of, said grooved lateral edge portion of said upper element, for accepting and accommodating said key bit in axial alignment with said keyway, said grooved lateral edge portion of said lower element having said abutment shoulder secured thereto in laterally offset position relative to said grooved lateral edge portion of said upper element and such that said shoulder is spaced above and overlies a portion of said keyway, said key being positionable adjacent to said obstruction member and being laterally shiftable toward said member, so that said post of said key will be received in said grooved lateral edge portion of said upper element and said bit of said key may be slid beneath said upper element and received within said grooved lateral edge portion of said lower element, with said notched portion thereof in abutting and mating relationship with said shoulder.

3. The assembly according to claim 2, wherein said post has a generally cylindrical configuration of reduced cross-section relative to that of said cylindrical sidewall of said bit, and wherein said grooved lateral edge portions of said upper and lower elements of said obstruction member, each has a generally U-shaped configuration, the cross-sectional dimensions of which substantially correspond to that of said post and bit, respectively.

4. The assembly according to claim 3, wherein said upper element and lower elements of said obstruction member each has a generally disc-shaped configuration, with said lower element having a greater diameter than that of said upper element.

5. The assembly according to claim 4, wherein said obstruction member is rotatably movable between a first position which prevents alignment of said key bit with said keyway, and a second position which permits alignment of said key bit with said keyway.

6. The assembly according to claim 5 additionally including a hollow housing having a first opening in which said obstrution member is rotatably received, and a second opening which merges with said first opening, into which said key may be inserted to permit laterally shifting thereof toward said obstruction member, said second opening being positioned so as to permit insertion and removal of said key only when said obstruction member is in its first position.

7. The assembly according to claim 5, wherein said first and second positions of said obstrution member are totatably offset by 180 degrees.

8. The assembly according to claim 5, wherein said upper element of said obstruction member is rotatably received in said first opening of said housing, with said lower element disposed in said housing and underlying said first opening.

9. The assembly according to claim 6, wherein said hollow housing has a generally cup-shaped configuration and includes a generally circular base in which said openings are formed, and a generally cylindrical sidewall secured to said base.

10. The assembly according to claim 1, wherein the distance between the lower edge of said shoulder and said keyway is less than said fixed distance of permissable key bit insertion into said keyway.

11. The assembly according to claim 1, wherein said notched portion of said key bit has a generally L-shaped profile and is formed at a corner portion of said bit joining said base and sidewall thereof, and wherein said abutment shoulder has a complementary L-shaped profile and is formed at the base of said grooved lateral edge portion of said lower element adjacent to the top surface thereof.

* * * * *